US006760922B1

(12) United States Patent
Morales

(10) Patent No.: US 6,760,922 B1
(45) Date of Patent: Jul. 13, 2004

(54) TACTICAL VEST WITH CONCEALED CARRY POCKET

(75) Inventor: Francisco J. Morales, Modesto, CA (US)

(73) Assignee: 5.11 Inc., Modesto, CA (US)

( * ) Notice: Subject to any disclaimer, the term of this patent is extended or adjusted under 35 U.S.C. 154(b) by 0 days.

(21) Appl. No.: 10/455,130

(22) Filed: Jun. 5, 2003

(51) Int. Cl.[7] ..... A41D 3/02
(52) U.S. Cl. ..... 2/94; 2/250; 2/102; 224/911
(58) Field of Search ..... 2/93, 94, 102, 2/108, 69, 85, 247–252, 2.5, 115; 224/911, 901.6, 196, 901.8, 198, 238, 192, 912

(56) References Cited

U.S. PATENT DOCUMENTS 5,170,919 A * 12/1992 DeSantis et al. ..... 224/587
5,278,998 A * 1/1994 Book ..... 2/102
5,431,318 A * 7/1995 Garcia ..... 224/192
5,689,829 A * 11/1997 Rose ..... 2/77
5,692,237 A * 12/1997 Bennett ..... 2/93
6,131,198 A * 10/2000 Westrick ..... 2/102

* cited by examiner

*Primary Examiner*—Tejash Patel
(74) *Attorney, Agent, or Firm*—Thomas M. Freiburger

(57) ABSTRACT

A tactical vest particularly for police has a hidden pocket which extends between panels of fabric to the back of the vest and preferably completely around the vest to the opposite side. A large patch of material with loop fasteners, preferably nearly as tall as the pocket opening, is engagable against two strips of hook fasteners on the inner panel as a module. A gun holster with hook-type fasteners can be placed at any desired location on the module for convenient retrieval by the user. Similarly, the module itself can be located and oriented in any manner desired by the user. This versatility enables the officer to position his gun holster in a personally most convenient and most readily retrievable position.

16 Claims, 6 Drawing Sheets

TACTICAL VEST WITH CONCEALED CARRY POCKET

BACKGROUND OF THE INVENTION

This invention concerns garments, and in particular a tactical vest for police, for carrying a concealed weapon.

Vests have come in many different forms, including tactical vests for police. Hidden vest panels or pockets have been used for concealing a gun. See, for example, Bennett U.S. Pat. No. 5,692,237.

As shown in the above patent, pistol holsters using Velcro, for concealing in a vest, are known. However, prior tactical vests have not provided for convenience and ready retrieval of a gun or other weapon from a concealed area of the vest, nor have they provided for versatility in the placement of the holster and gun as in the present invention described below.

The following patents have some pertinence to this invention: U.S. Pat. Nos. 6,324,697, 5,894,976, 5,689,829, 4,998,654, 4,262,832, 4,106,121, 2,919,443, 2,476,665 and D414,014.

SUMMARY OF THE INVENTION

In accordance with the present invention, a police tactical vest has a conveniently accessed hidden pocket, to the side of the central zipper line of separation of the vest. Such a pocket may be provided at both left and right. Inside this pocket is a hook and loop fastener arrangement that provides for placing of a holster and handgun in any desired orientation and position for the user, and Chat enables very quick retrieval of the gun from the hidden pocket.

The concealed pocket or pockets are not visible from the outside, being formed between layers of fabric and with a vertical slot opening adjacent to the zipper or other fasteners at the vertical line of vest closure. Within each concealed pocket in a preferred embodiment is a pair of patches of Velcro hook and loop fastener material, preferably tracks or strips of hook VELCRO material, spaced apart and preferably parallel. The tracks may be vertically oriented. These VELCRO hook tracks or strips are on the inner panel of the concealed pocket, i.e., the outside surface of the panel closest to the body. The pair of hook fastener tracks can support a large VELCRO material patch, preferably of double-sided loop material, in a position and orientation as desired by the wearer. Such a position is in accordance with the user's comfort and convenience in drawing a handgun. The large patch of double-sided loop material supports a nylon gun holster having hook VELCRO, or it can support other weapons or items: telescoping baton, mace, pepper spray, spare magazines, radio, cell phone, handcuffs, etc. The term hook/loop fastener material is intended to mean either hook material or loop material as used in the appended claims.

In a preferred embodiment or the vest of the invention, the described concealed pockets are located at both left and right, with vertical pocket entry just behind the zipper or other closure device. The front of the vest can be closed with a single snap if desired, even though a zipper is present, for quickly accessing the primary weapon, usually the handgun in the concealed pocket. The pocket itself may be closed with patches of Velcro along the edge of the opening slot.

The tactical vest of the invention has a number of other preferred features. One is the inclusion of two outer pockets on the user's right, which can receive, for example, a two-way radio and/or a rifle magazine.

A pocket with horizontal zipper on the user's left front can be used for sunglasses, bullets, etc. This is a deliberately shallow pocket for reaching such items conveniently. Below that pocket on the left side is a deeper, bellowed pocket with elastic loops inside. These can be for a spare pistol magazines, film and/or a flashlight. The three elastic loops are formed by a single strip of elastic positioned horizontally across the inside of the pocket. The back of the vest has cargo pockets which can hold extra gear, including a water bottle.

It is therefore among the objects of the invention to provide significant improvements in police tactical vests, providing a number of conveniences and a concealed pocket for quick retrieval of a concealed weapon, the weapon being arranged for maximum comfort and retrieval convenience of the particular user. These and other objects, advantages and features of the invention will be apparent from the following description of a preferred embodiment, considered along with the drawings.

DESCRIPTION OF PREFERRED EMBODIMENTS

Figure 1:
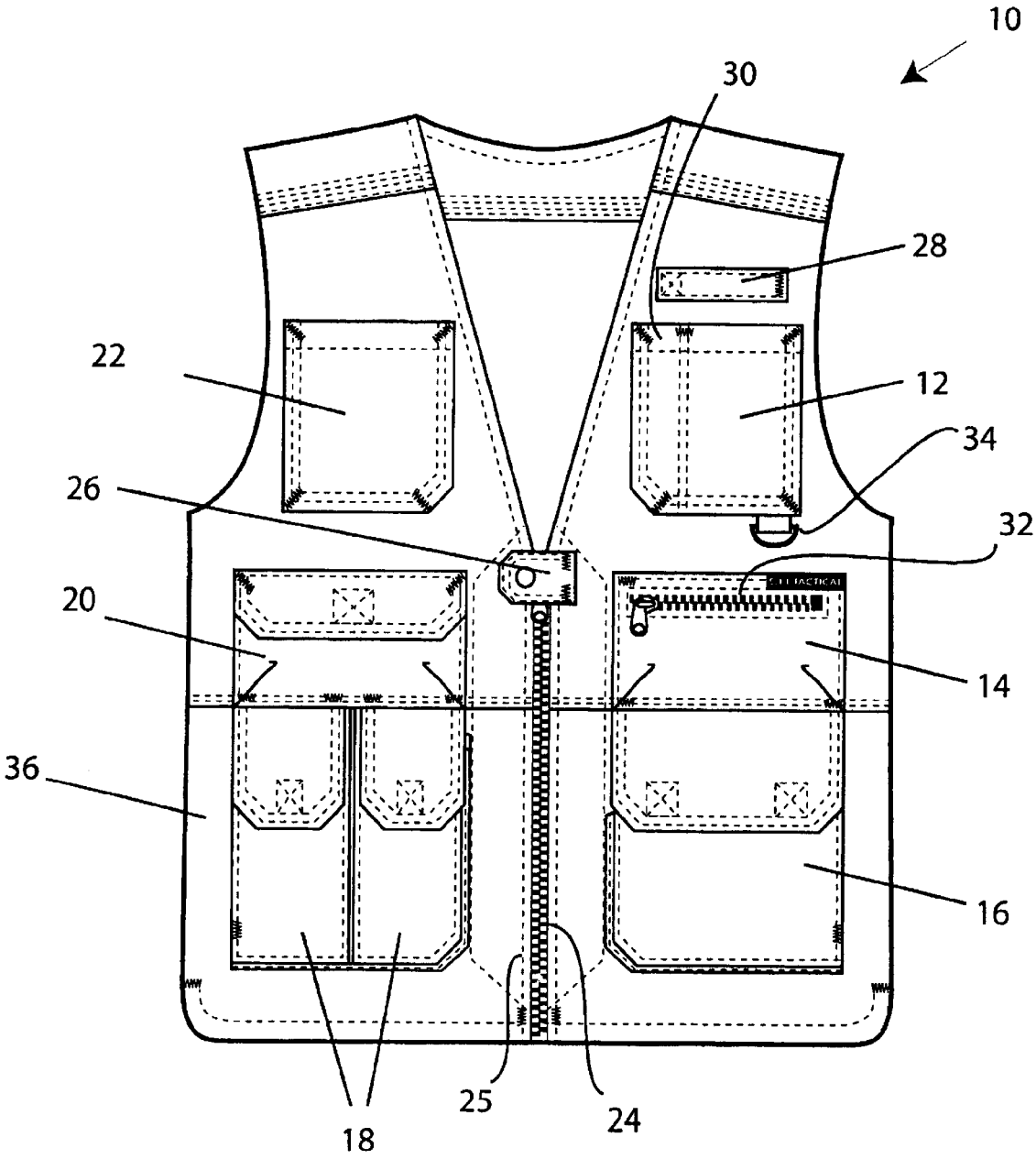
FIG. 1 is a front elevation view showing a vest of the invention, in a preferred embodiment.

FIG. 1 shows a tactical vest 10 according to the invention. This frontal view of the vest reveals a number of pockets 12, 14, 16, 18, 20 and 22 at left and right of the front of the vest. A zipper 24 preferably is provided for closure of the vest along a vest opening/closure line 25; in addition, a snap closure tab 26 may be included, for closing the vest only at this location, without engaging the zipper 24, when desired.

A preferred embodiment of the vest 10 includes a number of features visible in FIG. 1. At the vest's front left side are a Velcro badge tab 28; a narrow separate pocket 30 divided off from the pocket 12, for pens, a small flashlight, etc.; the pocket 14, made shallow and preferably with a horizontal zipper 32, for containing sunglasses, bullets, etc. for easy reach; the left side pocket 16 which is deeper and preferably bellowed, and with elastic loops inside to carry spare pistol magazines, film and/or a flashlight. The three elastic loops (not shown) in this pocket 16 may be formed by a single strip of elastic, positioned horizontally across the inside of the pocket, with stitching forming it into three separate loops.

On the wearer's right front are the pockets 18, narrow, deep and bellowed to hold taller items such as ammunition magazines, etc., and an additional shallow pocket is shown at 20. A brass key clip may be included at 34.

The vest 10 basically comprises a vest shell 36 essentially defining the exterior surface of the vest front and back (not necessarily a single piece of fabric), and including sewn-on fabric pieces to form the pockets and other features just discussed. On the interior side of the vest shell are additional fabric panels, not visible in FIG. 1 but discussed below.

Figure 2:
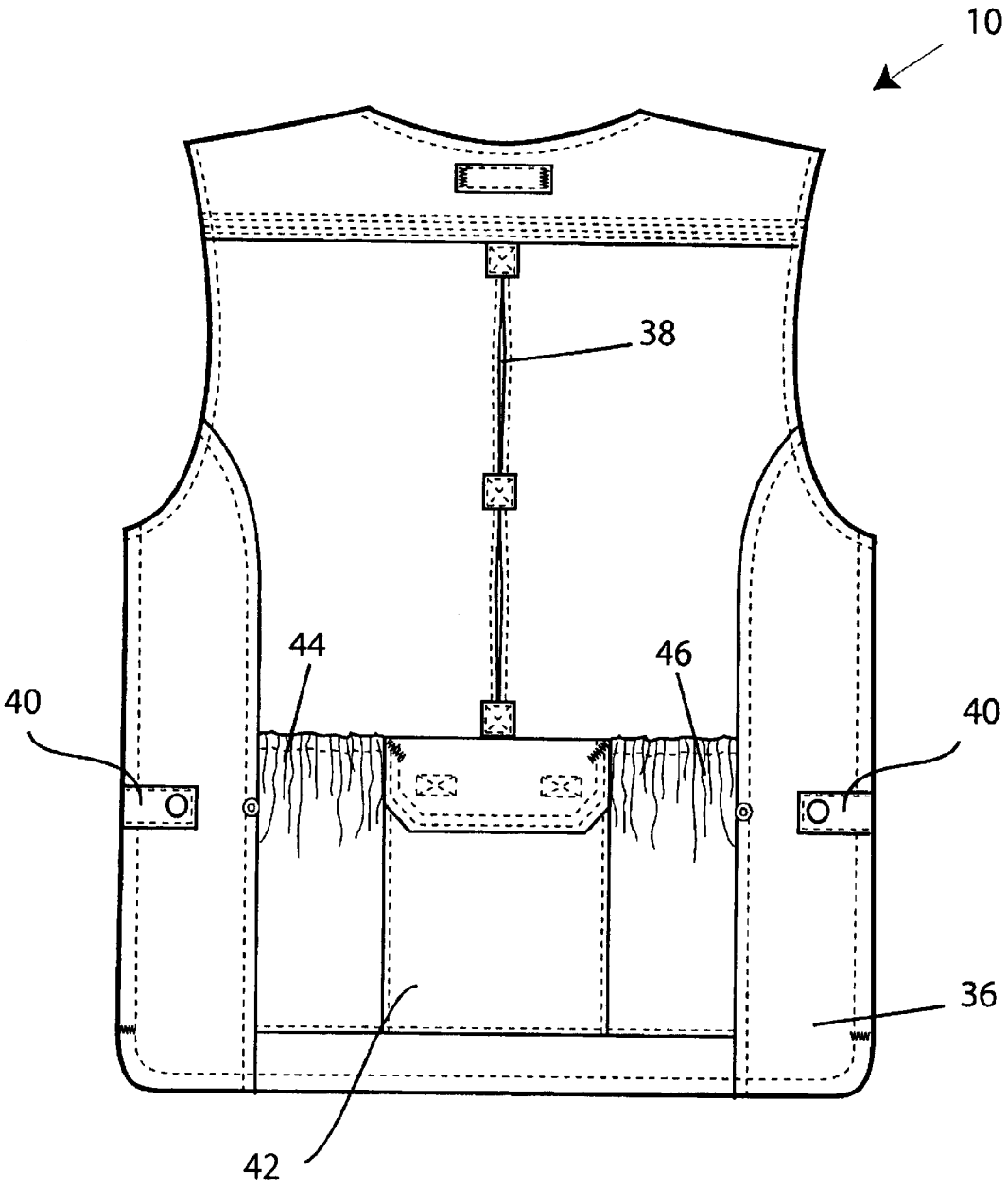
FIG. 2 is a rear elevation view of the vest of FIG. 1.

The back side of the vest 10 is shown in FIG. 2, including various additional features. A venting line may be provided at 38. Adjustable snap tabs are shown at 40, at left and right, for taking up some of the girth of the vest when needed. A cargo pocket is shown at 42, and water bottle pockets are shown at 44 and 46. An interior document pocket may be included, not visible in FIG. 2.

Figure 3:
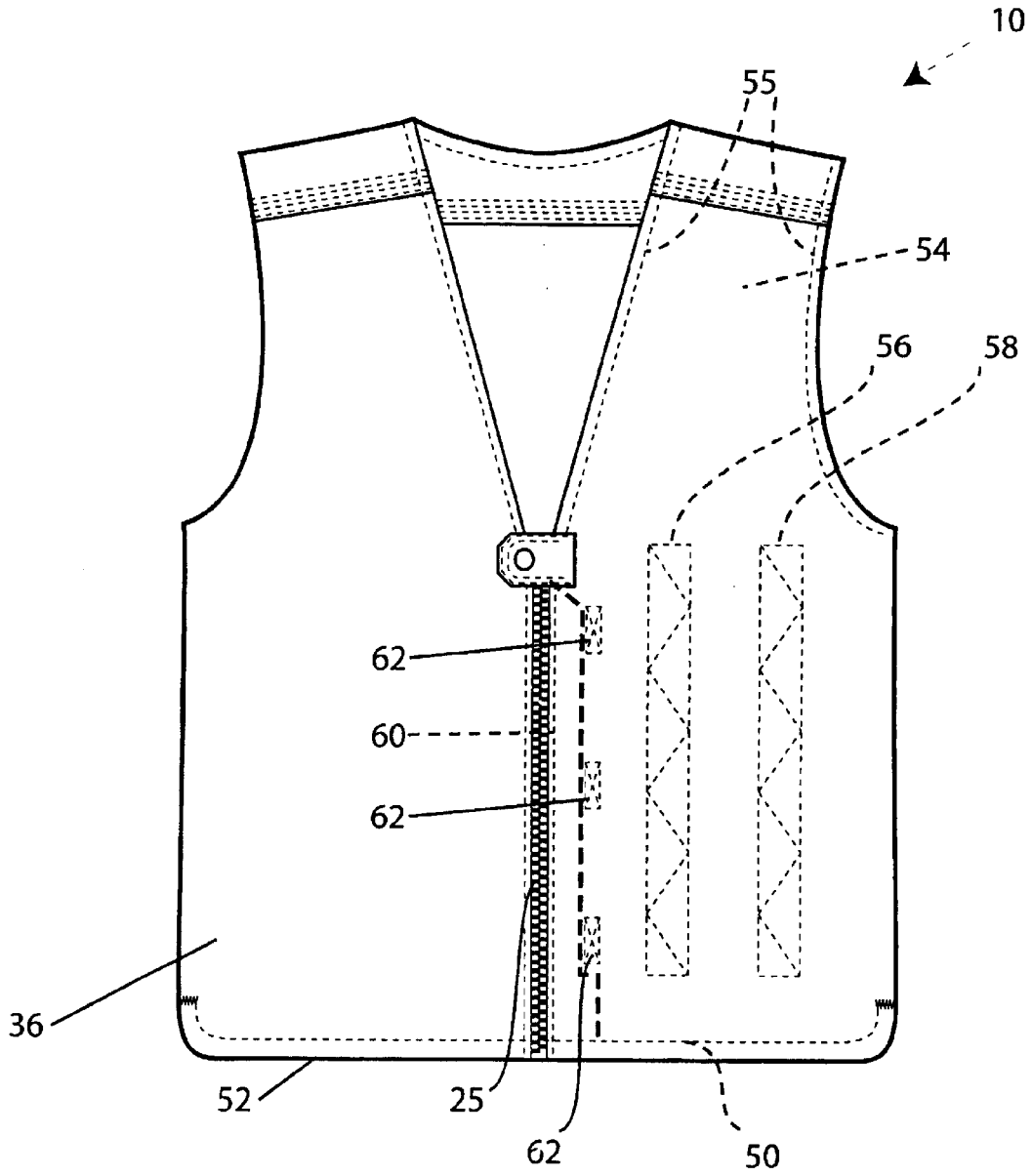
FIG. 3 is a front view similar to FIG. 1, but showing a hidden pocket in dashed lines and omitting, for clarity, exterior features of the vest shown in FIG. 1.
Figure 4:
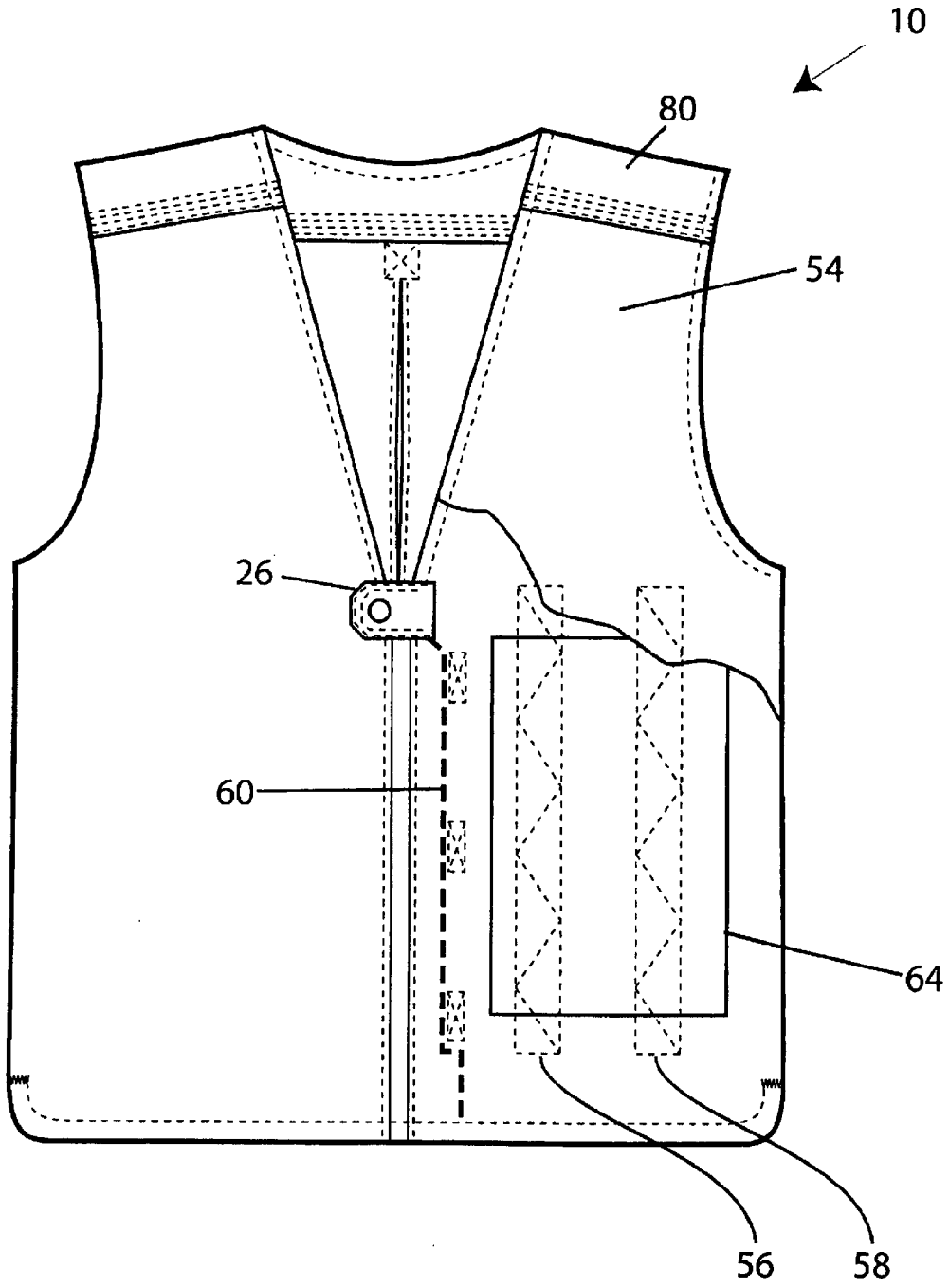
FIG. 4 is a cut-away elevation view of the vest, showing a handgun retention arrangement.

FIGS. 3 and 4 show an important feature of the invention, a concealed weapon carry pocket with special modular features. FIG. 3 shows the front of the vest 10, omitting exterior pockets and other features and showing the left and right front portions 50 and 52. As shown in dashed lines, the left side 50 of the vest shell 36 has an interior panel 54 sewn onto the interior side of the vest shell. This is indicated by dashed lines 55 indicating edges of the interior panel 54 and essentially where the panel is stitched to the outer shell. On the outer surface of the inner panel 54 are preferably provided two parallel strips or tracks of VELCRO hook and loop fastener material 56 and 58, shown in dashed lines, although this hook or loop fastener could take other configurations. These VELCRO material tracks or patch or patches provide a modular feature for carrying a handgun completely concealed but readily available. The strips 56, 58 may be hook fastener material, to be mated to loop type material. Along the parting line 25 of the vest, the inner panel 54 is not sewn together with the vest shell, but is left unstitched to form a vertically-oriented pocket opening, generally indicated in dashed lines at 60, delineating the edge of the inner fabric panel. This pocket opening slit 60 may be about 12 inches in height (although this may vary), closable via mating short patches of VELCRO hook and loop fastener material, shown in dashed lines at 62, preferably in two or three locations along the height of the pocket opening slit. This allows a hand to be quickly inserted into the concealed pocket to retrieve a handgun.

FIG. 4 shows the vest 10 with a portion cut away to reveal more details regarding the modular concealed weapon holding the arrangement. A large patch of VELCRO material 64, which may of the loop type VELCRO material on both sides, is engaged against the two strips of VELCRO material 56 and 58. The hooks and loops may be reversed if desired. As an be envisioned from FIG. 4, the large patch 64 of material, which may be roughly nine inches in height and about seven inches in width for a preferred embodiment, can be adjustably positioned on the fastener strips 56 and 58, moved up or down, left or right and rotated to the position desired. With the hidden pocket opening 60 about 12 inches in height, this allows the user to reach in, pull the VELCRO material panel 64 loose and reposition it as needed. Also, it allows a user to place a gun or other weapon on the large modular patch 64 in a desired position with the patch 64 is out of the vest. Then, the patch and weapon (or holster) are placed in the pocket as desired.

Figure 5:
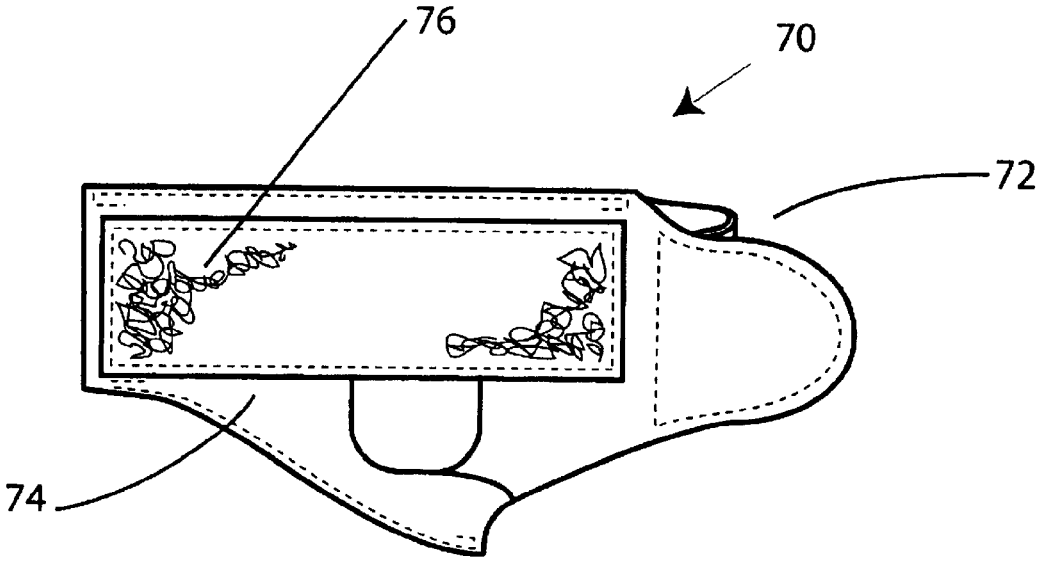
FIG. 5 shows a handgun holster of a type which may be used with the invention.

FIG. 5 shows a typical gun holster 70 for retaining a concealed handgun, a nylon holster with VELCRO material, such as shown in Bennett U.S. Pat. No. 5,692,237 cited above. The holster receives a handgun at an opening 72, and has a side 74 to which is secured a patch 76 of VELCRO material. This may be hook type VELCRO material on a concealed gun holster of this type. Prior nylon holsters have had VELCRO material patches but functioning only to hold the holster from moving around, not for supporting the holster as in this invention. FIG. 5 shows the inner side of the holster 70, thus the VELCRO material retaining patch 76 will be turned around against the modular VELCRO material 64 shown in FIG. 4, with this modular panel 64 thus being loop type Velcro material, at least on the surface facing outwardly as shown in FIG. 4. The user therefore has a large area provided by the VELCRO material panel 64 for arranging the handgun holster 70 in any desired position and orientation in accordance with the preferences of the user. The holster 70 will be positioned with its gun opening 72 facing toward the hidden pocket opening slit at 60, thereby allowing the user conveniently to reach into the pocket slit and retrieve the handgun via its butt end.

Figure 6:
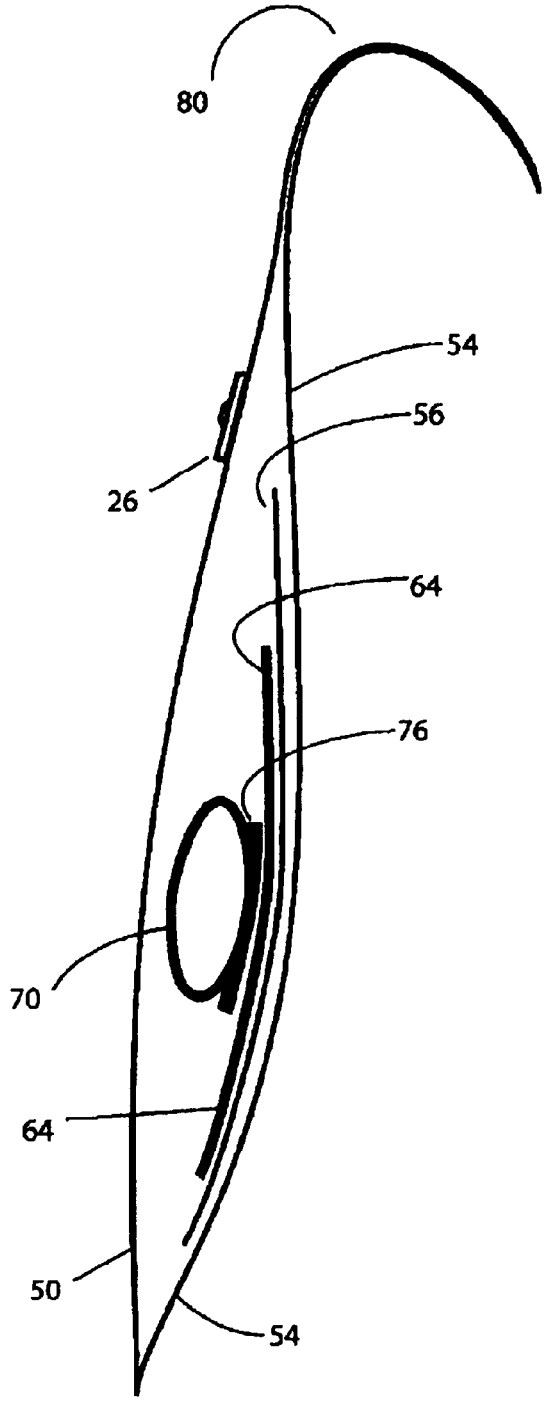
FIG. 6 is a cross-sectional elevation view of the vest, showing the hidden pocket.

FIG. 6 shows a portion of the vest as worn, in cross section, revealing the gun holster 70 secured to the VELCRO material panel 64 via the holster VELCRO material patch 76, and the panel 64 being attached to the vertical strips 56, 58 (which could be horizontal or otherwise).

In a modified arrangement a large VELCRO loop patch, such as 64 but only one-sided, could be fixed directly to the inner panel 54 of the concealed pocket, and the handgun holster 70 could be adjustably positioned on the fixed patch.

In one preferred embodiment as explained above the tactical vest 10 of the invention has concealed carry pockets at both left and right, although only the left pocket is shown in FIGS. 3 and 4. The interior space defined by the interior fabric panel 54 in the vest shell may extend throughout most of the vest shell, and in one form of the invention, the left pocket shown in FIGS. 3–4 actually continues around through the back of the vest (at least along lower portions of the vest) and into the right side concealed carry pocket. As shown in FIGS. 3 and 4, this space also extends upwardly to the shoulder 80 and preferably over the shoulder somewhat. This internal space is not necessarily contiguous for reasons of use, but this is a convenient method of manufacture.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A tactical vest for carrying a concealed weapon, comprising:

a fabric shell in the shape of a vest, without arms and with a front having left and right sides and a vertical central opening line at the front with fastener means to close the vest at the opening line, a hidden pocket in one side of the vest front, with a vertically oriented side opening generally at the opening line of the vest, the hidden pocket being formed between the front of the fabric shell and an inner piece of fabric material, said inner piece being sewn permanently to the fabric shell such that the hidden pocket is not visible from the front of the vest, a patch of hook and loop fastener material inside the hidden pocket and secured on the inner piece of fabric, a removable modular panel with hook/loop fastener material on both sides, the modular panel being large enough in area to fill most of the pocket at said one side of the vest, and a weapon with attached hook/loop fastener material, the weapon being retained onto said modular panel via the hook/loop fastener material, the weapon being so oriented by adjustable positioning on the modular panel within the pocket, as to be comfortably and quickly retrievable by a wearer of the vest.

2. The tactical vest of claim 1, wherein the weapon comprises a holster with a handgun.

3. The tactical vest of claim 1, wherein the patch of hook and loop fastener material inside the hidden pocket comprises hook material, and wherein the modular panel has loop material on both sides.

4. The tactical vest of claim 1, including two said hidden pockets, one at each side of the vest front.

5. The tactical vest of claim 4, wherein said two pockets comprise parts of a cavity continuous around the vest, through the back.

6. The tactical vest of claim 1, wherein said fastener means includes a zipper.

7. The tactical vest of claim 6, wherein the fastener means further includes one or more snap connections.

8. The tactical vest of claim 1, the front of the vest including at least four exposed pockets.

9. The tactical vest of claim 8, including additional exposed pockets on a back side of the vest.

10. The tactical vest of claim 9, wherein the inner piece of fabric material extends up to the shoulder of the vest at both left and right sides and extends around the lower back of the vest, connecting the left and right hidden pockets contiguously.

11. The tactical vest of claim 1, wherein the hidden pocket is closed at said vertically oriented side opening by discrete, spaced apart patches of hook/loop material.

12. A tactical vest for carrying a concealed weapon, comprising:

a fabric shell in the shape of a vest, with a front having left and right sides and a vertical central opening line at the front with fastener means to close the vest at the opening line, a hidden pocket in one side of the vest front, with a vertically oriented side opening generally at the opening line of the vest, the hidden pocket being formed between the front of the fabric shell and an inner piece of fabric material, said inner piece being sewn permanently to the fabric shell such that the hidden pocket is not visible from the front of the vest, hook and loop fastener means, on the inner piece of fabric within the hidden pocket, a weapon with attached mating hook and loop fastener means for engaging with the hook and loop fastener means inside the hidden pocket, the weapon being retained onto said hook and loop fastener means inside the hidden pocket, the weapon being so oriented by adjustable positioning on the hook and loop fastener means within the pocket, as to be comfortably and quickly retrievable by a wearer of the vest.

13. The tactical vest of claim 12, wherein the weapon comprises a holster with a handgun.

14. The tactical vest of claim 12, wherein the weapon comprises a telescoping baton.

15. The tactical vest of claim 12, wherein the weapon comprises mace or pepper spray.

16. The tactical vest of claim 12, wherein the hidden pocket is closed at said vertically oriented side opening by discrete, spaced apart patches of hook/loop material.

* * * * *